United States Patent [19]

Ticehurst et al.

[11] Patent Number: 4,709,568

[45] Date of Patent: Dec. 1, 1987

[54] LUBRICATION OF ROLLING MILLS

[75] Inventors: Roy M. Ticehurst; Joseph L. Watson, both of Bournemouth, England

[73] Assignee: Davy McKee (Poole) Limited, Dorset, England

[21] Appl. No.: 872,394

[22] Filed: Jun. 10, 1986

[30] Foreign Application Priority Data

Jun. 10, 1985 [GB] United Kingdom ..... 8514599
Jun. 10, 1985 [GB] United Kingdom ..... 8514597

[51] Int. Cl.[4] ..... B21B 27/10
[52] U.S. Cl. ..... 72/201; 72/236
[58] Field of Search ..... 72/200, 201, 202, 236, 72/128, 45

[56] References Cited

U.S. PATENT DOCUMENTS 3,913,369 10/1975 Field et al. ..... 72/201 X
4,061,010 12/1977 Stock et al. ..... 72/201
4,272,976 6/1981 Pizzedaz ..... 72/45
4,403,492 9/1983 Hope ..... 72/201

FOREIGN PATENT DOCUMENTS 0056540 7/1982 European Pat. Off. ..... 72/201
0114535 8/1984 European Pat. Off. ..... 72/201
1433301 4/1976 United Kingdom ..... 72/201

*Primary Examiner*—E. Michael Combs
*Attorney, Agent, or Firm*—Schwartz, Jeffery, Schwaab, Mack, Blumenthal & Evans

[57] ABSTRACT

A rolling mill has a plurality of rolls, means to direct liquid coolant on to the rolls at the ingoing side of the mill mounted on backing supports and a casing or casings enclosing the directing means during operation. The casing or casings have contact seals engaging the rolls to prevent unwanted egress of coolant on to work entering the mill. Sealing means are provided between the casing or casings and the backing support or supports and the casing or casings can be withdrawn from the mill for maintenance purposes independently of said one or more backing supports.

11 Claims, 3 Drawing Figures

LUBRICATION OF ROLLING MILLS

FIELD OF THE INVENTION

This invention relates to rolling mills and methods of rolling metal, such as aluminum, in rolling mills.

BACKGROUND OF THE INVENTION

It is customary in rolling mills to apply a coolant to the rolls and/or the work to hold the temperature of the work within reasonable limits regardless of the heat generated during rolling. The coolant is usually water or is water-based. It has been customary to also include a rolling lubricant, for example, in the form of an oil-water emulsion.

However, when water-based coolant contacts aluminium strip, it reacts with the aluminum to cause staining of the strip surface, which may inhibit the action of the rolling lubricant, even if applied separately from the coolant. The result is that the reduction effected in the mill is non-uniform across the strip width so that strip with poor flatness is produced. Further, the hardness of the stained areas differs from that of the remainder of the strip and this difference causes unequal reduction in any subsequent rolling operation and further loss of flatness. Lastly, the appearance of the rolled material is marred.

To overcome these problems, European Patent Specification No. 0160381A proposes a method of rolling metal in a rolling mill in which liquid coolant is applied to a roll or rolls on the ingoing side of the mill within a casing or casings, unwanted egress of coolant from the casing or casings being prevented by the use of contact seals engaging the roll or rolls. Rolling lubricant is independently applied to the work and/or the work rolls at the ingoing side of the mill outside the casing or casings.

This method has several advantages. Thus, as the coolant is applied on the ingoing side of the mill in a casing or casings from which unwanted egress of coolant is effectively prevented, because of the direction of rotation of the rolls, there is minimal possibility of coolant being transferred through the nip between the work rolls and their back-up rolls and thence to the work at the outgoing side.

Secondly, contact seals are used, which are more effective than air seals in preventing escape of moisture. Their use is possible because the rolls at the ingoing side of the mill are at a reasonably low temperature and because the contact seals are lubricated by the coolant. No coolant mist is generated and there is no escape route for the mist even if it were generated. The contact seals further act as cleaners for the rolls and prevent particulate material being carried into the roll gap by the rolls and damaging the rolls and the work.

Thirdly, rolling lubricant is applied separately from the coolant at the ingoing side of the mill and outside the casing or casings. The separate application of rolling lubricant is essential because of the effectiveness of the contact seals but, apart from that, it enables the lubricant to be distributed more evenly, makes possible better control of the lubricant, and can result in better efficiency of lubricant usage.

However, it will be appreciated that the use of contact seals between the rolls and the casing arrangement used requires the provision of effective end seals at the ends of the rolls. The end seals must provide effective contact with both a work roll and its associated back-up roll extending over the region of the nip between the two rolls.

Inevitably the contact seals are subject to wear and will require repositioning or replacement when worn in order to ensure effective operation. Shut down of the rolling mill for seal maintenance is clearly economically undesirable. Furthermore, even on shut down, the positioning of the seals in close proximity to the mill rolls makes maintenance access difficult.

Regular roll maintenance, for example, for regrinding of the work rolls, is an accepted feature of rolling mill operation, whereby the rolls are withdrawn sideways from the mill to a roll change car for transfer to a regrinding or storage station and fresh rolls are then moved into position to define the roll gap.

OBJECTS OF THE INVENTION

It is an object of the present invention to provide a rolling mill in which it is possible to synchronise seal maintenance with roll maintenance.

It is a further object of the invention to provide a method of rolling metal in a rolling mill in which seal maintenance and roll maintenance are synchronised.

These and other objects of the invention will become apparent from the following description and claims.

SUMMARY OF THE INVENTION

According to this invention, we provide a rolling mill comprising a plurality of rolls, means for directing liquid coolant on to the rolls at the ingoing side of the mill and a casing or casings which during operation enclose the directing means and have contact seals engaging the rolls to prevent unwanted egress of coolant from the casing or casings on to work entering the mill, wherein the means for directing liquid coolant on to the rolls are mounted on one or more backing supports, sealing means are provided between the casing or casings and the backing support or supports and the casing or casings are mounted for withdrawal from the mill for maintenance purposes independently of said one or more backing supports.

DESCRIPTION OF THE PREFERRED EMBODIMENTS

Preferably said one or more backing supports are movable away from the mill rolls during maintenance. The backing supports may suitably be mounted on a bridle assembly for control of the work tension upstream of the roll gap. The bridle assembly may be mounted so that it can be pivoted away from the rolls during maintenance Preferably the mill comprises a pair of work rolls each having an associated back-up roll, a separate casing being provided for each work roll having contact seals adapted to engage the work roll and its associated back-up roll.

The casing or casings are preferably carried by chocks for the work rolls.

The sealing means preferably comprises an inflatable peripheral seal between the or each backing support and the or each casing. Preferably means are provided for adjusting the position of the casing or casings to varying roll diameters and varying nips between adjacent back-up and work rolls. The contact seals may be provided with inflatable means for urging the seals into contact with the rolls. Such sealing and adjustment means are described in our co-pending application Ser. No. [85,144], 7/14/86.

A preferred form of face seal contacting a roll substantially across its entire width comprises a wiper strip of resilient material held in parallel with a support block of low friction material biased towards the adjacent roll.

According to a further aspect of this invention, we provide a method of rolling metal in a rolling mill having a plurality of rolls including a pair of work rolls, which method comprises directing liquid coolant from coolant supply means mounted on one or more backing supports on to the rolls at the ingoing side of the mill during operation within a casing or casings having contact seals engaging the rolls to prevent unwanted egress of coolant on to the work entering the mill and wherein said work rolls are periodically withdrawn for maintenance purposes together with said casing or casings independently of said one or more backing supports.

One form of the invention will now be described with reference to the accompanying drawings.

Figure 2:
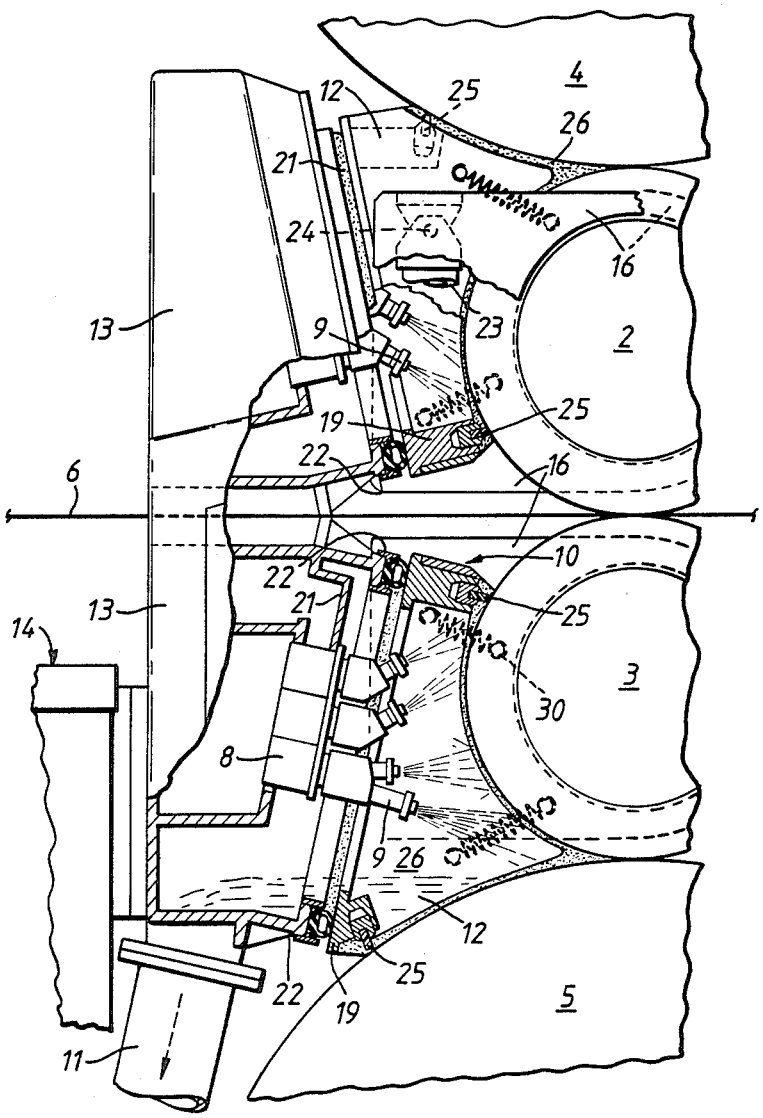
FIG. 2 is a side elevation, partly in section, of a portion of the assembly shown in FIG. 1 in operative position.

As shown in the drawings, the rolling mill has upper and lower work rolls 2 and 3, respectively, and upper and lower back-up rolls 4 and 5, respectively. The work, for example, aluminum strip, is indicated at 6, the direction of movement of the work being from left to right. Coolant is applied to the rolls at the ingoing side of the mill, i.e. at the left-hand side of the rolls in the drawings. Spray bars 8 are in use located, respectively, above and below the pass line and extend the full length of the rolls and have at closely spaced intervals sets of spray nozzles 9 directed at the work rolls, the back-up rolls and the nips therebetween. The spray bars are preferably as described in European Patent Specifications Nos. 0041863B and 0153532A. Each spray bar 8 is in use located within an enclosed sealing chamber 10, as shown in FIG. 2, which contains totally the coolant discharged by the nozzles 9 and prohibits the egress of coolant on to the strip 6. Used coolant is withdrawn from the chambers via discharge outlet 11, upper and lower chambers being interconnected for this purpose by any suitable means.

Figure 1:
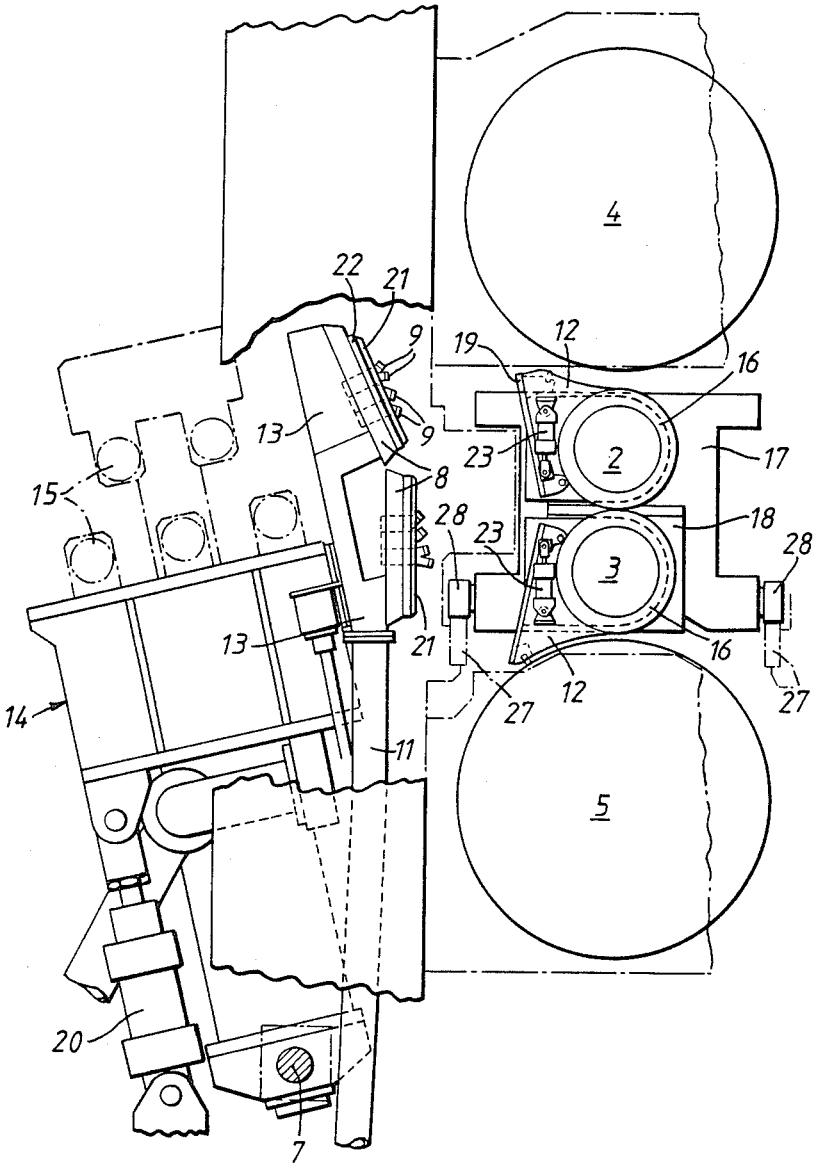
FIG. 1 is a side elevation of part of a rolling mill and bridle assembly, shown in a position suitable for roll changing.

The sealing chambers 10 are each in two separable parts, i.e. an open-backed casing 12 and a backing frame 13. Backing frames 13 are interconnected and mounted on the side of a bridle assembly 14, best seen in FIG. 1, for control of work tension upstream of the roll gap by means of a series of rollers 15. Bridle assembly 14 is pivoted at 7 to a suitable fixed support, so that, during roll maintenance, it can be pivoted away from the rolls by operation of piston and cylinder arrangement 20, as shown in FIG. 1. Backing frames 13 provide a mounting for the spray bars 8 so that, during rolling, as shown in FIG. 2, the bars 8 are enclosed within the sealing chambers 10.

The open-backed casings 12, on the other hand, are mounted on mounting plates 16 attached to work roll chocks 17 and 18 for the upper and lower work rolls 2 and 3, respectively. The open rear face of each casing 12 has a frame 19 against which can seal an inflatable ring seal 21 positioned around the facing periphery 22 of backing frame 13. Hydraulically operated piston and cylinder arrangements 23 are each pivotally connected to mounting plates 16 at one end 24 while the other end is attached to the frame 19 of casing 12. Springs 30 are connected between plate 16 and casing 12. Thus casings 12 are urged towards the roll nips between the rolls 2 and 4 and the rolls 3 and 5 and can accommodate to varying roll diameters and varying nip conformations. The inflation of ring seal 21 ensures that the sealing chamber is sealed to prevent egress of coolant while the rolling mill is in operation.

Casings 12 are provided with face seals 25 and end seals 26. These seals may be constructed as described in co-pending application Ser. No. [85,144] and, if required, nip sealing blocks may be incorporated to seal into the nips between the back-up and work rolls.

Figure 3:
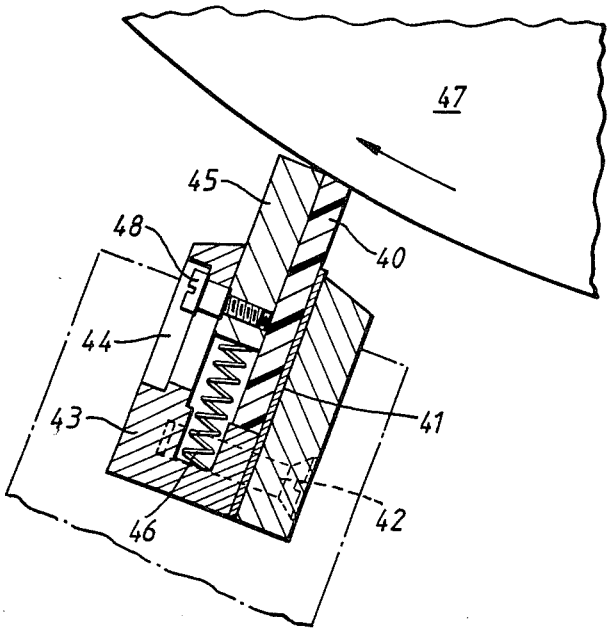
FIG. 3 is a sectional fragment of an assembly as shown in FIG. 2 showing a modified face seal.

An alternative form of face seal is shown in FIG. 3. Conventional seals comprise a block of suitable seal material, such as polyurethane, removably mounted in a holder from which the seal projects. The seal tends to wear along one edge and can be remounted up to four times in the holder to redistribute the wear. However, back-up rolls, which normally have a poorer surface finish than that required for work rolls, cause increased wear on the seals. Thus, for example, a seal which lasts up to 300 hours against a work roll may require replacement after only 30 hours against a back-up roll. The seal shown in FIG. 3 seeks to extend the wear life of the seal. Thus the seal is in the form of an elongate strip 40, for example, of polyurethane, adhered to a metal strip 41 and clamped by screw 42 within a holder 43. Holder 43 is apertured to accommodate a seal support block 45, for example, of graphite, loaded by spring 46 so that it will extend from the holder 43 but adjust to the length of strip 40 as the roll, a portion of which is shown at 47, rotates. Thus as strip 40 wears, for example, over a length of 10 mm, support block 45 will continue to support the block and adjust itself to project to the same extent as strip 40 from holder 43. Block 45 can also be adjusted in relation to spring 46 by location screw 48 housed in slot 44.

It will be seen that it is possible to adjust the seal to give a convenient wear life to correlate with a desired working shift so that seal maintenance and replacement can be carried out in conjunction with the roll grinding or replacement operation.

In use, when it is desired to change the work rolls 2 and 3, the back-up rolls 4 and 5 are moved vertically away from the work rolls to the positions shown in FIG. 1. The bridle assembly 14 with backing frame 13 and spray bars 8 is pivoted away from the mill. The work roll chocks 17 and 18 are then moved transversely, via wheels 28 supported on rails 27 within the mill, on to a roll change car (not shown) provided with rails in alignment with rails 27. A suitable transfer device is provided to move the work rolls out through the window provided in the mill housing on to the roll change car. The car carries a replacement roll stack, complete with seal casings 12, mounted on further sets of rails which can then be moved into the mill using the transfer device.

The removed rolls, with the associated casings 12 can then be transferred to, for example, a roll grinding shop. Any necessary maintenance work on the seals can be carried out at the same time.

It will be appreciated that only the minimum shut down time for roll change will be necessary thus ensuring efficient operation.

We claim:

1. A rolling mill comprising
a plurality of mill rolls;
means for directing liquid coolant onto the rolls at the ingoing side of the mill;
one or more backing supports on which are mounted the coolant directing means;
a casing or casings which during operation enclose the coolant directing means and have contact seals which engage the rolls to prevent unwanted egress of coolant from the casing or casings onto work entering the mill;
sealing means between the casing or casings and the backing support or supports; and
mounting means for the casing or casings for withdrawal of the casing or casings from the mill for maintenance purposes independently of said one or more backing supports.

2. A rolling mill according to claim 1, wherein the or each backing support is movable away from the mill rolls during maintenance.

3. A rolling mill according to claim 1, wherein the or each backing support is mounted on a bridle assembly for control of the work tension upstream of the roll gap.

4. A rolling mill according to claim 3, wherein the bridle assembly is mounted so that it can be pivoted away from the rolls during maintenance.

5. A rolling mill according to claim 1, wherein the sealing means between the or each casing and the or each backing support comprises an inflatable peripheral seal.

6. A rolling mill according to claim 1, wherein the contact seals are provided with inflatable means for urging the seals into contact with the rolls.

7. A rolling mill according to claim 1, wherein the contact seals comprise face seals extending substantially across the entire width of the rolls in contact therewith, with face seals comprise wiper strips of resilient material held in parallel with a support block of low friction material biased towards the adjacent roll.

8. A rolling mill comprising
a pair of work rolls;
a back-up roll associated with each work roll; and, for each work roll and associated back-up roll;
means for directing liquid coolant onto the work roll and back-up roll at the ingoing side of the mill;
a backing support on which is mounted the coolant directing means;
a casing enclosing the coolant directing means and having contact seals engaging the work roll and back-up roll to prevent unwanted egress of coolant from the casing onto work entering the mill;
sealing means between the casing and the backing support; and
mounting means for the casing for withdrawal of the casing from the mill for maintenance purposes independently of the backing support.

9. A rolling mill according to claim 8, wherein the casings are carried by chocks for the work rolls.

10. A rolling mill according to claim 8, wherein the backing supports are mounted on a bridle assembly for control of the work tension upstream of the roll gap, the bridle assembly being mounted so that it can be pivoted away from the rolls during maintenance.

11. A method of rolling metal in a rolling mill having a plurality of rolls including a pair of work rolls, comprising:
providing coolant supply means mounted on one or more backing supports;
directing liquid coolant from said supply means during operation of the mill onto the rolls at the ingoing side of the mill;
containing the liquid coolant within a casing or casings having contact seals engaging the rolls to prevent unwanted egress of coolant onto the work entering the mill; and
periodically withdrawing said work rolls for maintenance purposes together with said casing or casings independently of said one or more backing supports.

* * * * *